United States Patent [19]

Rullier et al.

[11] Patent Number: 4,915,405

[45] Date of Patent: Apr. 10, 1990

[54] BINDING WITH DOUBLE-ACTING RELEASE MECHANISM

[75] Inventors: Pierre Rullier, Annecy; Jean-Claude Brischoux, Seynod, both of France

[73] Assignee: Salomon S.A., Annecy Cedex, France

[21] Appl. No.: 52,414

[22] Filed: May 21, 1987

[30] Foreign Application Priority Data

May 22, 1986 [FR] France ..... 86 07838

[51] Int. Cl.[4] ..... A63C 9/08

[52] U.S. Cl. ..... 280/634; 280/626; 280/631

[58] Field of Search ..... 280/631, 632, 626, 634, 280/633, 614, 620, 615

[56] References Cited

U.S. PATENT DOCUMENTS

| | | | |
|---|---|---|---|
| 817,497 | 1/1986 | Dimier . | |
| 3,689,095 | 9/1972 | Salomon | 280/628 |
| 3,873,112 | 3/1975 | Covini | 280/620 |
| 4,140,332 | 2/1979 | Beyl | 280/626 |
| 4,183,549 | 1/1980 | Salomon | 280/632 |
| 4,218,071 | 8/1980 | Salomon | 280/630 |
| 4,222,584 | 9/1980 | Kikuchi | 280/626 |
| 4,402,525 | 9/1983 | Salomon | 280/628 |
| 4,508,361 | 4/1985 | Svoboda et al. | 280/628 |
| 4,538,828 | 9/1985 | Dimier | 280/628 |
| 4,553,772 | 11/1985 | Boussemart et al. | 280/628 |
| 4,603,880 | 8/1986 | Salomon | 280/628 |
| 4,624,473 | 11/1986 | Knabel et al. | 280/632 |
| 4,674,766 | 6/1987 | Ramer | 280/614 |
| 4,687,221 | 8/1987 | Salomon | 280/620 |
| 4,714,267 | 12/1987 | Abondance et al. | 280/615 |

FOREIGN PATENT DOCUMENTS

| | | |
|---|---|---|
| 0305106 | 12/1980 | Austria . |
| 2916348 | 11/1979 | Fed. Rep. of Germany . |
| 3104633 | 12/1981 | Fed. Rep. of Germany . |
| 2027531 | 10/1970 | France . |
| 2031883 | 11/1970 | France . |
| 2138694 | 1/1973 | France . |
| 2314742 | 1/1977 | France . |
| 2338060 | 8/1977 | France . |
| 2385418 | 10/1978 | France . |
| 2416701 | 7/1979 | France . |
| 2418656 | 9/1979 | France . |
| 2419737 | 10/1979 | France . |
| 2420359 | 10/1979 | France . |
| 2424037 | 11/1979 | France . |
| 2458299 | 1/1981 | France . |
| 2469189 | 5/1981 | France . |
| 2480130 | 10/1981 | France . |
| 2494591 | 5/1982 | France . |
| 2515969 | 5/1983 | France . |
| 2527464 | 12/1983 | France . |

*Primary Examiner*—Charles A. Marmor
*Assistant Examiner*—Eric Culbreth
*Attorney, Agent, or Firm*—Sandler & Greenblum

[57] ABSTRACT

A safety binding adapted to releasably hold a boot on a ski includes an apparatus for securing the binding to the ski, a movable body with spaced lateral arms pivotably connected to the apparatus transversely to the longitudinal extent of the ski, and a jaw pivotably connected to the body along a transverse axis. The jaw includes a device for engaging and holding a portion of the boot on the apparatus when the boot is positioned on the apparatus and the binding is attached to a ski. The binding includes a device for biasing the jaw and body towards the ski and increasing the bias on the jaw when the body moves upward. A safety binding, adapted to secure one end of a boot to a ski, includes an apparatus for securing the binding to the ski, a body with spaced lateral arms pivotably connected to the apparatus along a transverse axis, and a jaw pivotably connected to the body along a transverse axis. The jaw includes a device for retaining an end of the boot. The binding includes a device for biasing the a jaw towards the ski, which includes an elastic energy storing element, a jaw ramp located on an inner surface of the jaw, and a pressure element slideably contacting the jaw ramp. The binding further includes a lever, pivotably connected to the apparatus along a transverse axis, which includes an upper portion located between the first pressure element and the elastic energy storing element.

75 Claims, 8 Drawing Sheets

BINDING WITH DOUBLE-ACTING RELEASE MECHANISM

BACKGROUND OF THE INVENTION

1. Field of the Invention

The present invention relates to a safety binding for securing a boot to a ski. More precisely, the invention relates to a binding adapted to retain one end of the boot.

2. Description of Background and Relevant Information

Bindings are known that generally have a jaw adapted to retain one end, particularly the rear end, of a boot on the binding. The jaw is journalled around a transverse axis with respect to a body connected to the ski.

Energization means are also generally known that exert an action on the jaw, which tends to return the jaw towards the ski or on the contrary to pivot it upwardly, depending upon the intensity of the force exerted by the sole of the boot on the jaw.

Normally, the energization means comprise a spring lodged in the body, whose initial compression is adjustable. The spring presses against a pressure element which, depending upon the case, can be a slidable piston or a journalled rocker, which presses in turn against a ramp of the jaw.

The ramp of the jaw generally has a zone of elastic extent which, when in contact with a pressure element, elastically returns the jaw towards the ski, and a release zone which, when in contact with the pressure element, pushes the jaw upwardly. The limit between the two zones defines the release threshold of the binding.

Such bindings are known particularly based upon French Patents 2,338,060 and 2,494,591.

The disadvantage of these apparatus is that the user must furnish a substantial force to manually remove the boot from the binding, because in effect he must furnish an energy equivalent to the release energy that the boot transmits to the binding for a release during skiing.

Moreover, these bindings require a spring for the release and one or more other springs to assure an elastic return of the binding, particularly so as to follow flexional movements of the ski.

In addition, the initial compression of the return springs is not generally adjustable, and particularly cannot be adjusted in relation to the compression of the spring of the energization means.

There exist however bindings where the compression of the return springs can be adjusted, but by adjustment means independent of the energization means.

SUMMARY OF THE INVENTION

A safety binding is described which is adapted to releasably hold a boot on a ski. The binding includes means for securing the binding to the ski; a movable body having spaced lateral arms pivotably connected to the securing means along a first axis which is substantially transverse to the longitudinal extent of a ski on which the binding is adapted to be positioned; and a jaw pivotably connected to the body along a second axis which is substantially transverse to the longitudinal extent of the ski. The jaw includes means for engaging and holding a portion of the boot on the securing means when the boot is positioned on the securing means and the binding is attached to the ski. The binding additionally includes means for biasing the jaw and the body towards the ski, and means for increasing the biasing force exerted by the biasing means on the jaw in response to upward movement of the body.

In one particular embodiment, the securing means inlcude a platform having a lower surface adapted to abut the upper surface of the ski, an upper surface adapted to support the sole of the boot, and two portions adapted to receive the spaced lateral arms. The platform may include means for guiding the spaced lateral arms slideably over a portion of the platform along the longitudinal extent of the ski, in which case the spaced lateral arms are adapted to be connected to the guiding means. These guiding means may comprise slots adapted to receive the spaced lateral arms, and the spaced lateral arms may each include a pin adapted to be pivotably connected to a slot in the platform.

The two portions of the platform which are adapted to receive the spaced lateral arms may comprise two grooves which are substantially parallel to the longitudinal extent of the ski.

In another embodiment, the platform is adapted to be slidably connected to the ski along at least a portion of the longitudinal extent of the ski, and the binding further comprises means for elastically returning the binding along the ski in one predetermined direction. These elastically returning means may comprise at least one spring.

In a preferred embodiment, each spaced lateral arm includes a first portion connected at a free end of the arm to the first axis and extending towards the moveable body along a direction which is substantially parallel to the longitudinal extent of the ski, and a second portion extending from the first portion, with the second portion being adapted to project upwardly from the upper surface of the ski towards the binding.

In another preferred embodiment, the spacing between the lateral arms is less than or equal to the width of a sole of the boot adapted to be positioned on the ski, and is less than or equal to the width of the platform.

The jaw of the binding may comprise an upper extension adapted to engage the upper surface of the sole of the boot, a lower extension adapted to engage a bottom surface of the sole of the boot, and a ramp located on an inner surface of the jaw. This jaw ramp may further comprise an upper compressive zone, a lower opening zone adjacent to the upper zone, and a ridge positioned between the zones.

The upper zone comprises means for compressing elastic energy storing means when the jaw pivots upwardly away from the ski, whereby the upper zone is biased with increasing force and the jaw is increasingly biased back towards the ski. The lower zone comprises means for decompressing the elastic energy storing means and for biasing the jaw upwardly from the ski.

In another particular embodiment the biasing means of the safety binding include means for storing elastic energy, and means for reversibly transferring elastic energy from the elastic energy storing means to the jaw. These elastic energy storing means may be located along a line which is substantially horizontal, with respect to the longitudinal extent of the ski, when the binding is at its lowermost position with respect to the ski, or may alternatively be located along a line which forms an angle to the longitudinal extent of the ski when the binding is at its lowermost position with respect to the ski. The elastic energy storing means may comprise at least one spring.

In a further embodiment of the present invention, the safety binding includes means for adjusting the amount of elastic energy stored in the elastic energy storing means. The adjusting means may include a screw which compresses the elastic energy storing means when the screw is rotated in a first direction, and which decompresses the elastic energy storing means when the screw is rotated in a second direction.

The energy transferring means may comprise a second pressure element in contact with the elastic energy storing means, a lever in contact with the second pressure element, and a first pressure element which includes a first portion in contact with the lever and a second portion in contact with a ramp located on an inner surface of the jaw. The second pressure element may comprise a pin adapted to be slidably connected to the first pressure element by a rocker plate which engages the pin.

In a particular embodiment, a portion of the second pressure element that is in contact with the lever includes a ramp, and the ramp of the second pressure element includes means for compressing the elastic energy storing means when the body pivots upwardly away from the ski. The second pressure element ramp may further comprise a projecting lip at its lower portion, which comprises means for limiting movement of the safety binding away from the ski.

The second pressure element may comprise a piston adapted to be mounted slideably with respect to the longitudinal extent of the ski in an orifice of the body, or alternatively the second pressure element may comprise a rocker device pivotably connected to the body along an axis which is substantially transverse to the longitudinal extent of the ski.

This rocker device may include first and second ends, the substantially transverse axis pivotably connecting the rocker device to the body may be located at the first end of the rocker device, the second end of the rocker device may contact the elastic energy storing means, and an intermediate rocker device portion between the first end and the second end may contact the second pressure element.

The lever of the safety binding may be pivotably connected, along an axis which is substantially transverse to the longitudinal extent of the ski, to means for securing the lever to the ski, and the means for securing the lever to the ski may be adapted to be spaced from the means for securing the binding to the ski along an upper ski surface. In one particular embodiment, the lever securing means and the binding securing means are positioned substantially on opposite sides of the body. Moreover, the lever may comprise a lower end which is pivotably connected along the substantially transverse axis, and an upper end, the upper end comprising a first surface facing the second pressure element and a second surface facing the first pressure element, wherein at least one of the first and the second surfaces comprises a pressure nose slideably contacting a ramp of the lever. In a particularly preferred embodiment, the lever ramp comprises means for compressing the elastic energy storing means when the body pivots upwardly away from the ski.

In another embodiment of the present invention, a ramp is located on the first pressure element, and the first pressure element ramp comprises means for compressing the elastic energy storing means when the jaw pivots upwardly away from the ski.

The lever of the safety binding may include upper and lower ends, with the lower end being pivotably connected to the means for securing the lever to the ski. The upper end may comprise first and second ramps, with the first lever ramp slideably contacting the second pressure element and the second lever ramp slideably contacting the first pressure element. At least one of the first and second lever ramps may comprise means for compressing the elastic energy storing means when the jaw pivots upwardly away from the ski, and/or means for compressing the elastic energy storing means when the body pivots upwardly away from the ski. In an embodiment wherein the binding is adapted to be mounted slideably with respect to the longitudinal extent of the ski, at least one of the first and second lever ramps may also comprise means for elastically returning the binding along the ski in a predetermined direction.

In yet another preferred embodiment, the first lever ramp includes a projecting lip at its upper portion which comprises means for limiting movement of the safety binding away from the ski.

The first pressure element may comprise a piston which is in contact with the elastic energy storing means, and which is slideably mounted in the body longitudinally with respect to the longitudinal extent of the ski. An end of the piston may comprise a pushing element. A ramp may be located on an inner surface of the jaw, wherein the pushing element comprises a first pressure nose which slideably contacts the jaw ramp and a second pressure nose which slideably contacts the second pressure element. The second pressure element may comprise a pin adapted to be mounted slideably longitudinally with respect to the body, and the piston may comprise means for guiding the pin longitudinally with respect to the longitudinal extent of the ski. These guiding means may comprise slots located on substantially opposed surfaces of the piston.

The first pressure element of the binding may comprise a rocker arm which is pivotably connected along an axis which is substantially transverse with respect to the longitudinal extent of the ski. This rocker arm may comprise a pressure nose, which slideably contacts the jaw ramp, with the rocker arm also including means for slideably guiding the second pressure element substantially longitudinally with respect to the ski. In a particularly preferred embodiment, the second pressure element comprises a pin mounted transversely with respect to the longitudinal extent of the ski, which is adapted to slide along the guiding means of the rocker arm.

The binding may include a manual release lever, which comprises means for disengaging a boot from the binding when the boot is positioned on the ski.

In one particular embodiment, the securing means are attached to an upper ski surface.

In yet another embodiment, the safety binding is adapted to secure one end of a ski boot to a ski, and the binding includes means for securing the binding to the ski; a body having spaced lateral arms pivotably connected to the securing means along an axis which is substantially transverse to the longitudinal extent of the ski; a jaw pivotably connected to the body along an axis which is substantially transverse to the longitudinal extent of the ski, with the jaw further comprising means for retaining an end of the boot; means for biasing the jaw towards the ski, with the biasing means comprising elastic energy storing means, a jaw ramp located on an inner surface of the jaw, with a first pressure element slideably contacting the jaw ramp; and a lever pivotably connected to the securing means along an axis which is substantially transverse to the longitudinal extent of the ski, with the lever comprising an upper portion located between the first pressure element and the elastic energy storing means.

The spaced lateral arms may be pivotably connected to the securing means at a position located in front of the position where the lever is pivotably connected to the securing means, as viewed with respect to the ski when the binding is attached thereto. Alternatively, the spaced lateral arms may be pivotably connected to the securing means at a position located to the rear of the position where the lever is pivotably connected to the securing means, as viewed with respect to the ski when the binding is attached thereto.

The pressure element may comprise a first pressure nose which slideably contacts a ramp on the lever, and the lever ramp may include means for compressing the elastic energy storing means when the body pivots away from the ski.

In another embodiment, the first pressure element may comprise a ramp which slideably contacts a first pressure nose on the lever. This pressure element ramp may include means for compressing the elastic energy storing means when the body pivots away from the ski.

In yet another embodiment, the first pressure element comprises a rocker device pivotably connected to the body along an axis which is substantially transverse with respect to the longitudinal extent of the ski, wherein a second pressure element comprises a pin slideably connected to the rocker device.

The first pressure element may include a rocker device pivotably connected to the body along an axis which is substantially transverse with respect to the longitudinal extent of the ski. A second pressure element may comprise a piston slideably connected to the body.

Alternatively, the first pressure element may include a first rocker device pivotably connected to the body along an axis which is substantially transverse with respect to the longitudinal extent of the ski, and a second pressure element may comprise a second rocker device pivotably connected to the body.

The safety binding may include a second pressure element which contacts the lever at a location that is spaced vertically from the contact between the first pressure element and the lever.

In another embodiment of the present invention, the safety binding may include securing means adapted to be slideably connected to the ski along at least a portion of ski.

The securing means may include a platform to which the spaced lateral arms are adapted to be connected. The spacing between the lateral arms is preferably less than the width of the platform, which may further include two grooves, each of the grooves being adapted to receive at least a portion of one of the spaced lateral arms.

The pressure element of the safety binding according to the present invention may comprise a piston slideably connected to the body. This piston may include means for receiving at least a portion of the lever, as well as means for slideably guiding a second pressure element within the piston. This second pressure element may include a pin oriented transversely with respect to the longitudinal extent of the body, with the pin being slideably guided in the guiding means of the piston.

Alternatively, the second pressure element may include a first piston positioned slideably within a second piston which is mounted slideably within the body.

In one particular embodiment, the safety binding may include a second pressure element connecting the elastic energy storing means and the lever.

In another embodiment, the first pressure element of the safety binding may include a rocker device pivotably connected to the body along an axis which is substantially transverse with respect to the longitudinal extent of the ski, with a second pressure element comprising a pin being slideably connected to the rocker device.

Alternatively, the first pressure element may include a rocker device pivotably connected to the body along an axis which is substantially transverse with respect to the longitudinal extent of the ski, while the second pressure element includes a piston slideably connected to the body.

In another alternative, the first pressure element may include a first rocker device pivotably connected to the body along an axis which is substantially transverse with respect to the longitudinal extent of the ski, while the second pressure element includes a second rocker device pivotably connected to the body along a substantially transverse axis.

The safety binding of the present invention may include a lever ramp that has, at its upper portion, a projecting lip which provides means for limiting movement of the safety binding away from the ski.

In another embodiment, the substantially transverse axis along which the spaced lateral arms of the safety binding are connected to the securing means may be located on a platform which is adapted to be secured to the ski, with the axis being moveable over a portion of the platform with respect to the longitudinal extent of the ski.

In the safety binding of the present invention the second pressure element and and the lever may contact each other along a line, and the first pressure element and the lever may also contact each other along a line, with the two lines being offset from each other.

In another particular embodiment the first pressure element of the safety binding may comprise a piston slidably connected to the body, and the piston may include two side elements which encompass a portion of the lever and which provide means for slideably guiding the second pressure element with respect to the longitudinal extent of the body. The second pressure element may include a pin oriented transversely with respect to the longitudinal extent of the body, with the pin being guided in the guide means of the side elements of the piston.

Alternatively, the second pressure element may include a first piston mounted slideably within a second piston, which is mounted slideably with respect to the longitudinal extent of the body.

Furthermore, the safety binding of the present invention extends to an embodiment wherein the securing means are attached to an upper ski surface.

BRIEF DESCRIPTION OF THE DRAWINGS

The invention will be better understood with reference to the description which follows, given with reference to the annexed drawings in which.

DESCRIPTION OF PREFERRED EMBODIMENTS

One of the aims of the invention is to propose a binding for which the release energy to be overcome for a manual removal of the boot is generally less than that required for a release during skiing.

Another aim is to propose a binding which, in one particular embodiment of the invention, has common adjustment means for adjusting the release threshold and the intensity of the elastic return.

Another aim of the invention is to propose a binding which has a zone of elastic extent of substantial amplitude, and particularly of an extent greater than bindings whose jaw is simply pivotally mounted with respect to the body.

Other aims and advantages of the invention will become clear from the description which follows.

The safety binding of a boot according to the invention comprises:

(a) a jaw adapted to retain the end of the boot against the ski, the jaw being journalled around a transverse axis with respect to a body connected to the ski; and (b) energization elastic return means of the jaw, comprising elastic means for storing energy, and a pressure element cooperating with a ramp of the jaw on which it exerts a pressure.

The binding is further characterized by the fact that:

the body is carried by two lateral arms which are themselves journalled at their lower end around a transverse axis with respect to the ski, a lever is journalled at its lower end around a transverse axis with respect to the ski, and is interposed in its upper portion between the pressure element and the elastic means for storing energy of the energization means, such that the pressure exerted by the pressure element on the ramp of the jaw is transmitted from elastic means for storing energy to the pressure element by means of the lever and varies the position of the arms and of the body with respect to the ski.

The binding shown in the Figs. is of the type adapted to retain the heel of a boot.

However, the invention applies likewise to a binding adapted to retain the front of a boot.

Figure 1:
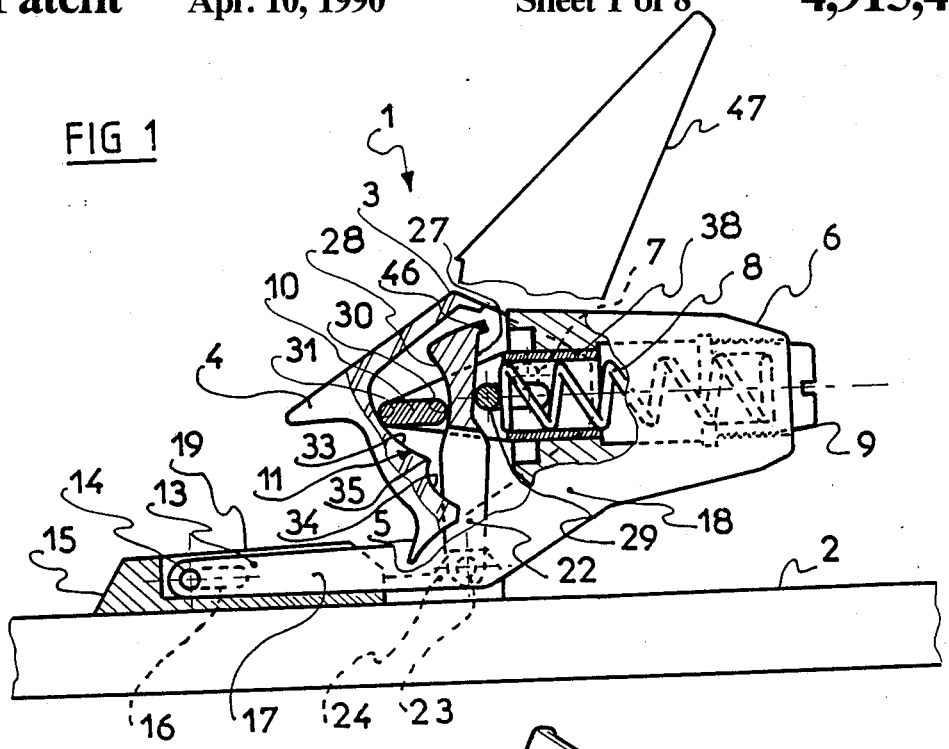
FIG. 1 illustrates a side view, in partial crosssection, of a safety binding in one non-limiting embodiment of the invention.

FIG. 1 illustrates a safety binding 1 which is rigidly assembled to the upper surface of the ski 2.

Binding 1 comprises a jaw 3 adapted to retain the sole of the boot at the level of a sole grip 4, which, in the case of a rear binding, is adapted to retain the heel of the sole. In a known fashion, jaw 3 comprises in its lower portion a tongue 5 on which the sole of the boot presses during insertion of the boot.

Binding 1 further comprises a body 6 with respect to which jaw 3 is journalled in rotation around a horizontal axis 7 that is transverse to the longitudinal direction defined by the ski. Axis 7 can be formed by a transverse pivot or by two coaxial pivot segments which connect each lateral wall of body 6 to a lateral side plate of jaw 3.

Energization means connect body 6 and jaw 3. These means are shown in FIG. 1 in the form of an energization spring, particularly a compression spring 8, seated in body 6, whose initial compression can be adjusted by a cap 9 screwed on the rear portion of body 6.

This configuration is not to be considered as limiting, and spring 8 can be replaced by any appropriate elastic means for storing energy, for example a jack filled with pressurized gas.

The energization means further comprise a pressure element, shown in FIG. 1 in the form of a head 10 of a piston 38, slidably mounted along a longitudinal direction. Spring 8 pushes elastically head 10 of piston 38 in the direction of jaw 3, and more precisely the front pressure nose 31 of head 10 against release ramp 11 of jaw 3, which will be described below.

FIG. 1 illustrates binding 1 in the closed position after the boot is inserted. From this position, under the effect of a vertical force exerted by the sole on jaw 3, the energization means define for binding 1 a zone of elastic extent, where jaw 3 is elastically returned in the direction of ski 2, and an opening zone to allow for the upward pivoting of jaw 3 when the vertical force is greater than a predetermined threshold. The border between the zone of elastic extent and the opening zone corresponds to the release threshold which can be adjusted by changing the initial compression of spring 8 by means of cap 9.

Binding 1 further comprises any appropriate means for manual removal of the boot. Such a means is schematically shown in the form of a boot removal lever 47 which the user activates by downwardly directed pressure.

According to the invention, body 6 of binding 1 is carried by two lateral arms 12 and 13, which are fixedly attached to the body and which connect it to the ski 2.

The lateral arms 12 and 13 are positioned substantially symmetrically with respect to the vertical plane of symmetry of the ski, and are journalled in rotation with respect to the ski 2, in their lower portion, around a transverse axis 14.

Preferably, transverse axis 14 is carried by a platform 15 affixed to ski 2 directly, or by means which adjust the longitudinal position of platform 15 on ski 2. Furthermore, in the embodiment shown, axis 14 is longitudinally movable in a slot 16 transverse to platform 15, extending longitudinally.

Figure 4:
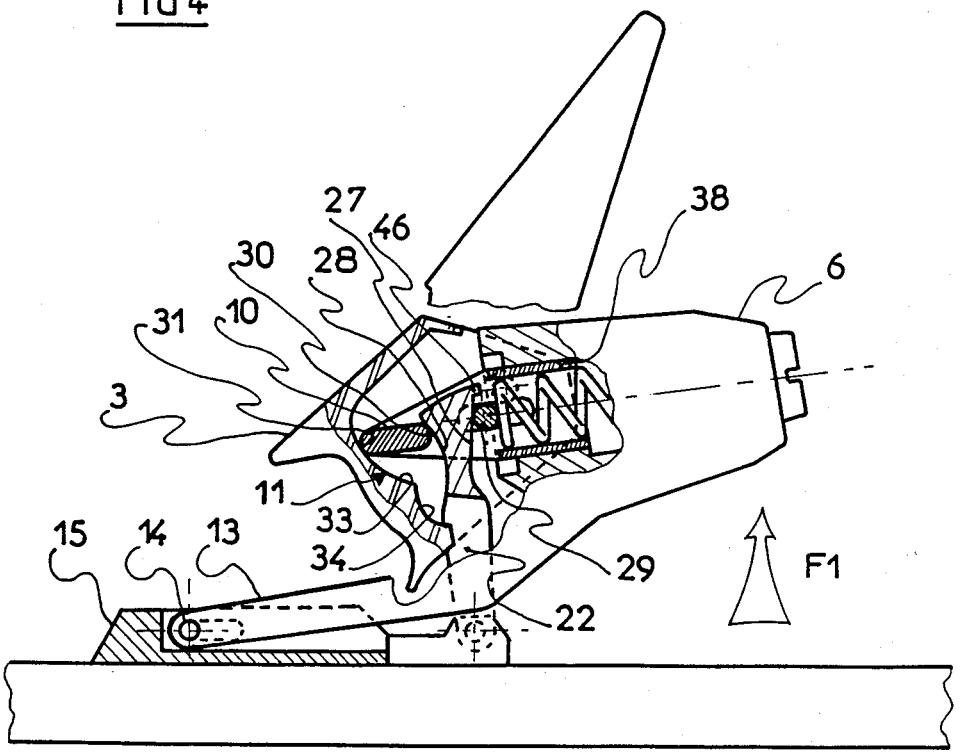
FIG. 4 illustrates in part the operation of the binding under the effect of a vertical force exerted on the body.
Figure 6:
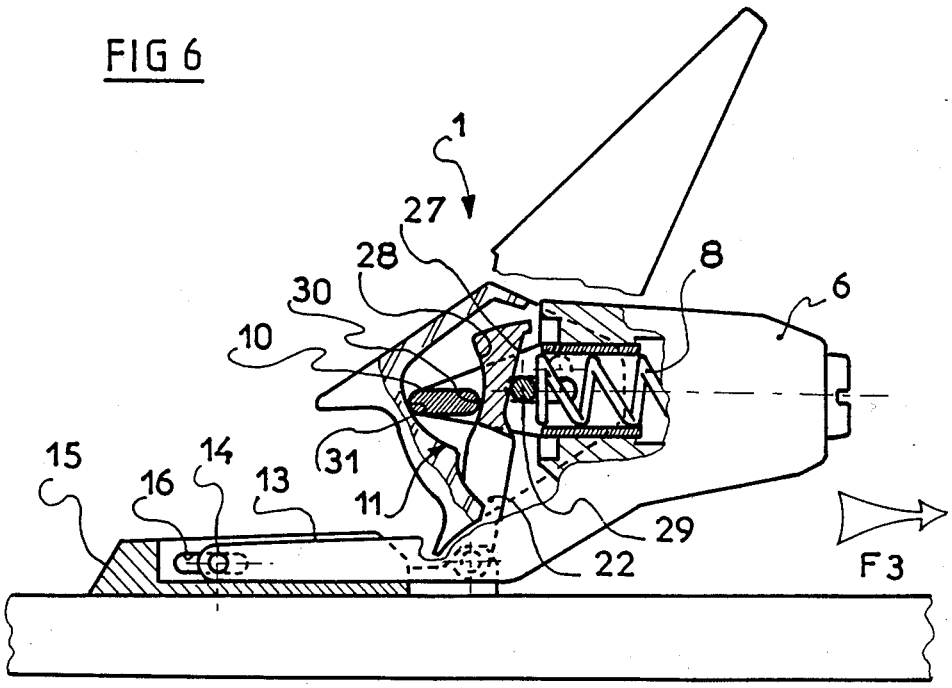
FIG. 6 illustrates the operation of the binding under the action of a horizontal return bias.

Thus, as illustrated in particular in FIG. 4, body 6 and lateral arms 12 and 13 are rotationally movable around axis 14, and as illustrated in FIG. 6, they are also longitudinally movable by sliding of axis 14 in slot 16.

In a preferred embodiment, the two arms 12 and 13 are bent, and have beginning at axis 14 a first portion 17, oriented substantially parallel to the upper surface of ski 2, followed by a second portion 18, which rises towards body 6.

Figure 2:
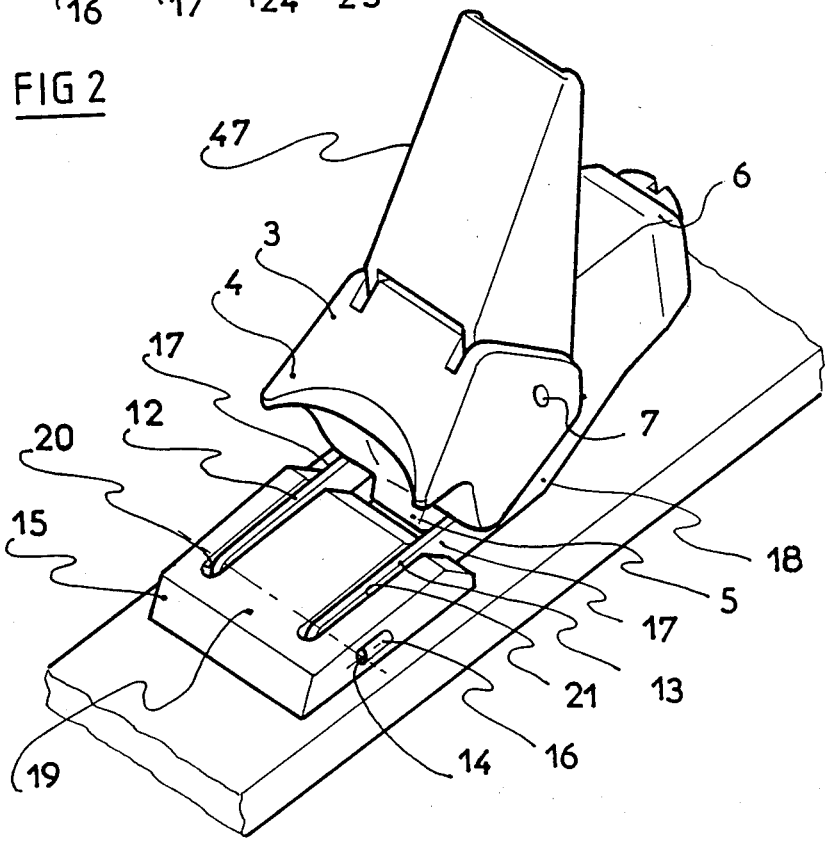
FIG. 2 is a perspective view of the binding of FIG. 1.

FIGS. 1 and 2, as well as the following Figs., illustrate the first portions of arms 12 and 13 which are parallel to one another and oriented from axis 14 towards the rear of the ski.

In this case, journal axis 14 of arms 12 and 13 and of body 6 is positioned in front of jaw 3.

Preferably platform 15, which serves as a bearing for axis 14, further furnishes an upper surface 19 on which the sole of the boot presses when the boot is inserted in the binding. Platform 15 can furthermore serve as a base plate for a known brakage apparatus, which is not shown.

Preferably, the spacing between the two arms 12 and 13, at the level of their first respective portion 17, is less than the width both of platform 15, and of a sole of a standardized boot. Platform 15 has two groove portions 20 and 21 which extend longitudinally from slot 16 towards the rear of platform 15, where they emerge. In these grooves are positioned, at least partially, the first portions 17 of arms 12 and 13. These portions of grooves 20 and 21 furnish a lateral guidance to arms 12 and 13, and allow for at least a partial retraction of their first portion 17 which further extends under the sole of the boot.

Arms 12 and 13 have any appropriate shape of transverse cross-section, for example an elongated shape, which is rectangular or ovoidal, and whose major dimension is oriented in the vertical plane.

Binding 1 further comprises a lever 22 which is journalled in its lower portion with respect to ski 2 around a transverse, horizontal axis 23. In particular, axis 23 is carried by a bearing 24, affixed to the ski, which extends platform 15 towards the rear.

Lever 22 extends substantially vertically above its journal axis 23, and in its upper portion comprises a head which is interposed between pressure element 10 of the energization means and the energy storage means, i.e., spring 8 in the case of FIG. 1.

Thus, the head of lever 22 transmits to ramp 11 of jaw 3 the pressure caused by spring 8.

By virtue of the fact that the head of lever 22 is interposed between pressure element 10 and spring 8, a relative movement between the head of lever 22 on the one hand, and pressure element 10 and spring 8 on the other hand, occurs when body 6 pivots around journal axis 14 which connects it to the ski.

Thus, by positioning pressure element 10 and spring 8, assemblies of ramps and the pressure nose, at the level of the connection of the head of lever 22, the pressure exerted by the spring on ramp 11 of jaw 3 can be modified according to the position of body 6 and arms 12 and 13 around axis 14. As a result, one modifies the release threshold of the binding.

FIG. 1 illustrates lever 22 with, on the side facing spring 8, a pressure ramp 27, and, on the side facing pressure element 10, a second ramp 28.

Spring 8 exerts a pressure on ramp 27 of lever 22 by means of a transverse pin 29 which is movable along the longitudinal direction of body 6 with respect to pressure element 10.

Pin 29 constitutes an auxiliary pressure element which acts conjointly with pressure element 10 to transmit the pressure of spring 8 in the direction of ramp 11 of the jaw.

From the other side, pressure element 10 undergoes a pressure exchange with lever 22, by means of a pressure nose 30 which is in contact with ramp 28.

On the other hand, pressure element 10 has a pressure nose 31 in contact with ramp 11 of jaw 3.

Preferably, ramps 27 and 28 of lever 22 are globally compressive, i.e., when pin 29 and pressure nose 30 run along ramps 27 and 28 upwardly, which corresponds to a lifting movement of body 6 and of arms 12 and 13, spring 8 of the energization means is compressed, and the pressure which it exerts on ramp 11 increases.

To achieve this, preferably each ramp is compressive, or one of them is compressive and the other is neutral.

Ramp 11, which is known as to itself, has two principal portions. It first has a zone of elastic extent 33 which, when in contact with pressure nose 31 of pressure element 10, tends to return jaw 3 in the direction of the ski. It furthermore comprises an opening zone 34 which, when in contact with pressure nose 31 of pressure element 10, tends to open jaw 3 upwardly, and thus to free the sole of the boot.

These two zones 33 and 34 are separated by a ridge 35, which represents the release threshold of the binding.

Furthermore, preferably ramp 27 has in its upper portion a lip 46, which constitutes an abutment for pin 29 so as to limit the amplitude of its upward movement.

Figure 3:
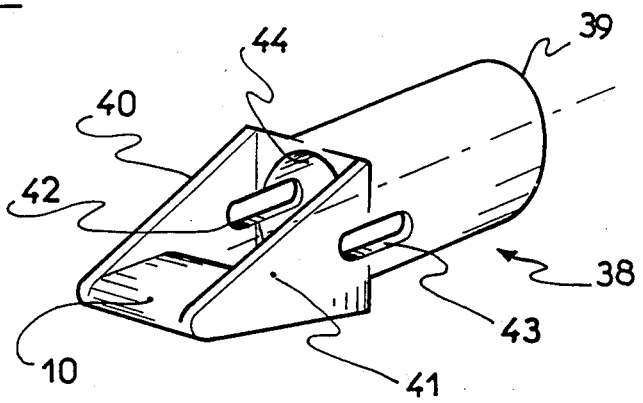
FIG. 3 illustrates in perspective one of the elements of the binding of FIG. 1.

FIG. 3 illustrates in perspective piston 3 of binding 1, which serves as an intermediary between spring 8, pin 29, and ramp 11 of jaw 3. Element 38 has at its rear portion a portion in the form of a cylinder of revolution 39, which is slidably guided longitudinally with respect to body 6. In its front portion, element 38 has pressure element 10 which is preferably connected to the cylindrical portion 39 by two lateral side plates 40 and 41. Element 38 furthermore has on its sides two slots 42 and 43, facing one another, which are oriented longitudinally, in which pin 29 is slidably guided longitudinally by its ends.

Furthermore, a longitudinal orifice 44, of diameter substantially greater than the diameter of spring 8, extends through cylindrical portion 39 and opens between side plates 40 and 41. Thus, spring 8 at the level of its end oriented towards jaw 3 extends through this orifice 44 both from end to end and comes to press against pin 29 which is guided in slots 42 and 43. If desired, an apparatus such as a ring or a small cup assures the linkage between the end of the spring and pin 29.

Preferably, slots 42 and 43, which guide pin 29, are situated above the level of pressure element 10 and more precisely above its pressure noses 30 and 31. In this fashion, the contact zone between pin 29 and ramp 27 of lever 22 is more elevated on lever 22 than the contact zone between pressure nose 30 and ramp 28.

Figure 5:
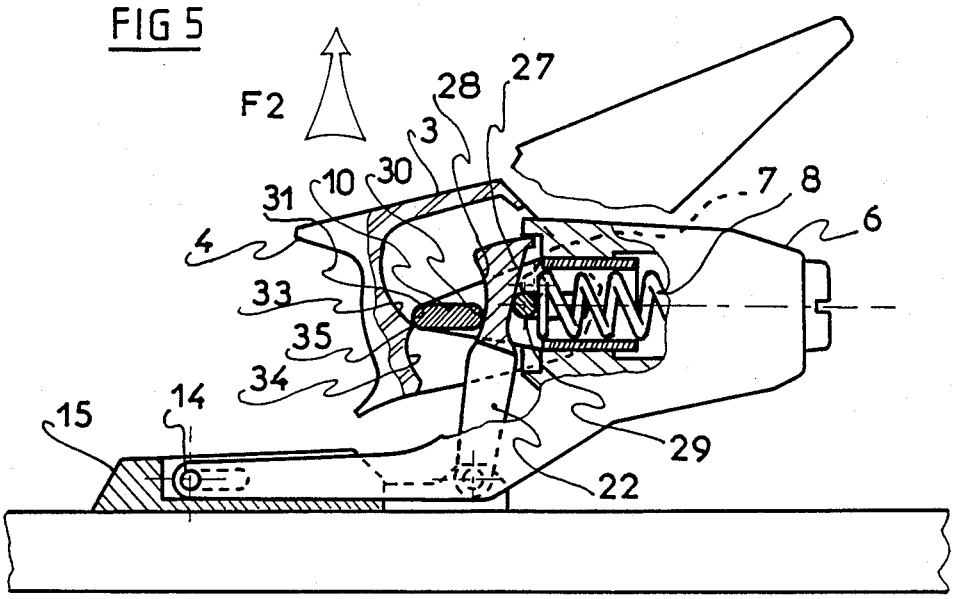
FIG. 5 illustrates in part the operation of the binding under the action of a vertical force exerted on the jaw.

The following FIGS. 4, 5, and 6 illustrate the operation of binding 1, respectively under the effect of a vertical upward bias exerted on body 6, of a vertical upward bias exerted on jaw 3, and of a horizontal return bias exerted on body 6.

These different biases have been deliberately isolated to illustrate the operation of binding 1 under the effect of each of them. Quite obviously, during skiing these different forces combine with one another, which is also the case the for relative displacements of the different elements of binding 1.

FIG. 4 illustrates binding 1 of FIG. 1, biased upwardly by a vertical force exerted on body 6, which has been schematically shown as F1.

In this Fig., it has been assumed that jaw 3 follows the rotation of arms 12 and 13 and of body 6 but has no relative movement with respect to body 6.

As is shown in FIG. 4, body 6 and arms 12 and 13 which carry it pivot upwardly around journal axis 14.

At the level of lever 22, pin 29 and pressure nose 30 of pressure element 10 respectively follow ramps 27 and 28 upwardly.

Lip 46 makes it possible to limit the displacement of pin 29, for which it constitutes an abutment. In this way, the upward rotational movement of body 6 and of arms 12 and 13 around axis 14 is limited. Naturally, any other appropriate limiting means may be used.

As was previously explained, the two ramps 27 and 28 are globally compressive for spring 8, whereby the pivoting movement of body 6 around its axis 14 causes a compression of spring 8. This compression tends to elastically return the body 6 and arms 12 and 13 in the direction of the ski. On the other hand, this compression also amplifies the pushing that the pressure nose 31 of pressure element 10 exerts on ramp 11 of the jaw.

At this point it should be noted that the pressure nose 31 is not substantially displaced on the elastic extent zone 33 of jaw 3. In a general manner, the pivotable movement of body 6 around its axis 14 does not substantially modify the position of pressure element 10 on ramp 11 of the jaw.

When force F1 ceases, the body 6 and arms 12 and 13 are returned in the direction of the ski by spring 8 which decompresses, pin 29 and pressure nose 30 running along ramps 27 and 28 towards the bottom.

In other terms, the intensity of the release threshold increases with a pivoting of body 6 and of arms 12 and 13 upwardly, and it diminishes with a downward pivoting.

FIG. 5 illustrates the operation of binding 1 under the effect of a vertical force schematically shown as F2, which is exerted on jaw 3, particularly at the level of sole-grip 4. In this Fig., it is assumed that body 6 and arms 12 and 13 remain in the lowered position, and are thus not influenced by this bias.

As is visible in FIG. 5, under the effect of force F2, jaw 3 pivots around its journal axis 7 which connects it to the body. Furthermore, pressure nose 31 of pressure element 10 runs along the zone of elastic extent 33 of jaw 3. FIG. 5 illustrates pressure nose 31 at the level of release threshold 35, and in a known fashion, if bias F2 has a sufficient amplitude, pressure nose 31 crosses ridge 35 and then runs along opening zone 34, Which results in a release of the boot.

The displacement of pressure nose 31 on ramp 11 of the jaw causes a compression of spring 8 which is transmitted by pressure element 10 through the head of lever 22 and pin 29.

At the level of lever 22 it must be understood that pin 29 and pressure nose 30 are not substantially displaced on their respective ramps 27 and 28. A slight displacement is caused, however, by the rearward pivoting of lever 22, which is due to the rearward movement of pressure element 10. However, this displacement is negligible with respect to the preceding displacement described with respect to FIG. 4.

Thus, in this case, one can consider that the compression of the spring is due only to the displacement of pressure nose 31 of pressure element 10 on ramp 11 of the jaw.

FIG. 6 illustrates binding 1, biased by a horizontal return force F3, for example exerted on body 6 or arms 12 and 13.

Under the effect of such a force, body 6 and arms 12 and 13 retreat together, which causes a sliding of journal axis 14 of arms 12 and 13 in slot 16 of platform 15. As is clear from FIG. 6, the retreat of body 6 causes a rearward pivoting of lever 22. The pivoting of lever 22 occurs by an inclination of the head of the lever, which causes a relative spacing between pin 29 and pressure nose 30 of pressure element 10.

This relative spacing causes a compression of spring 8, which causes an elastic frontward return for body 6 and arms 12 and 13.

It should be noted that the more that pin 29 is offset upwardly on lever 22 with respect to pressure nose 30 of pressure element 10, the more the compression of spring 8 becomes substantial, during return, and the stronger the elastic frontward return becomes.

Likewise, it can be noted that the intensity of the elastic return depends directly on the initial compression of spring 8, i.e., that the intensity of the return is directly related to the adjustment of the release intensity of the binding.

Figure 7:
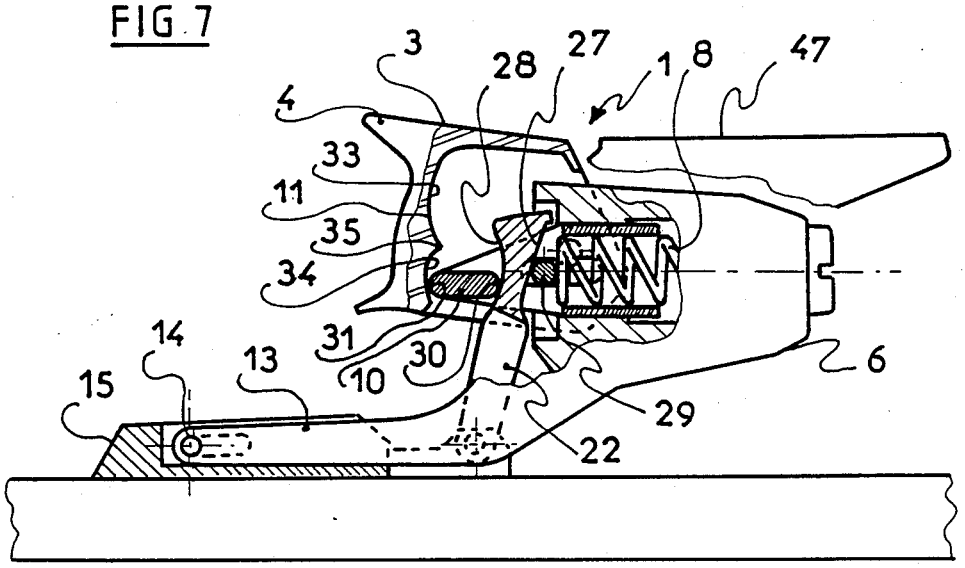
FIG. 7 illustrates the binding of the preceding Figures in a position where the shoe is removed.

FIG. 7 illustrates the binding 1 in the position where the boot is removed. This position is achieved after manual removal by means of boot removal lever 47, or after release of the binding and ejection of the boot during skiing.

In this position where the boot is removed, the pressure nose 31 of pressure element 10 is in contact with opening zone 34 of the jaw. At the level of lever 22, pressure nose 30 of pressure element 10, and pin 29, are at the bottom of their respective ramps 28, 27.

If from the position shown in FIG. 7, where body 6 and its arms 12 and 13 are in the lowered position, one biases body 6 upwardly, pressure nose 30 and pin 29 run upwardly along their respective ramps 28, 27, which causes a compression of spring 8 and elastic return of body 6 in the direction of the ski.

With the help of this Fig. it is possible to understand that the energy necessary to manually release the binding is less than that necessary for a release during skiing.

In effect, a release of the binding during skiing combines a vertical force of the jaw along F2, and a vertical force of the body along F1.

Each of these forces causes a compression of spring 8, and thus globally, the spring is compressed by zone 33 on the one hand and by ramps 27 and 28 on the other hand. The energy required for a release during skiing is the energy necessary to make pressure nose 31 of pressure element 10 cross ridge 35 of ramp 11, the spring 8 being furthermore additionally compressed, by virtue of the fact that pin 29 and pressure nose 30 have run along at least a portion of their ramps 27, 28.

On the other hand, during manual removal of the boot, the intervention of the user on lever 47 tends to press the body 6 and its arms 12 and 13 against the upper surface of the ski. As a result, pressure nose 30 of pressure element 10 and pin 29 are at the bottom of their respective ramps 28, 27 of lever 22.

The energy required for manual release is thus only the energy necessary to cause pressure nose 31 to cross ridge 35 of ramp 11, ramps 27 and 28 having in this case no influence on the compression of the spring.

The energy required for a manual release is thus less than the energy for a release during skiing, and the manual release is facilitated as a result.

In other terms, the release threshold of the binding 1 varies depending upon the angle of upward pivoting of arms 12 and 13 and of body 6. It increases with an upward pivoting movement and diminishes with a downward pivoting movement. During skiing, the forces of the boot on jaw 3 tend to pivot body 6 and arms 12 and 13 upwardly. As a result, the release threshold tends to increase. On the other hand, the manipulation of the release lever tends to press the arms 12 and 13 in abutment against the ski. The release threshold is thus brought back to its minimum value.

On the other hand, the necessary energy to close the binding by means of the boot is reduced. In effect, the movement of the boot during the act of putting the boot in the binding tends to press body 6 and its arms 12 and 13 against the upper surface of the ski. As a result, only ramp 11 of the jaw comes into play, and ramps 27 and 28 of the lever are inactive. The energy that the user must furnish to close the binding is the energy necessary to cross in the opposite direction ridge 35, the spring 8 not being further biased in compression with ramps 27 and 28. As a result, the energy necessary to insert the boot into the binding is reduced with respect to the prior art.

The relative inclinations of ramp 11 of jaw 3 and ramps 27 and 28 of lever 22 make it possible to distribute the force exerted by the boot on the jaw, during skiing, between a bias along F1, such as has been described relative to FIG. 4, and a bias along F2, such as has been described relative to FIG. 5. This force exerted by the boot on the jaw causes thus in combination a pivoting of jaw 3 relative to body 6 around axis 7, as well as a pivoting of body 6 around its axis 14 with respect to the upper surface of the ski 2.

Those of ordinary skill in the art will be able to determine the different parameters, particularly the shapes and inclinations of the ramps, in a fashion such that this allocation will be evenly distributed, for example such that during a vertical force exerted on the jaw, the pressure nose 31 of pressure element 10 comes into the vicinity of ridge 35 of ramp 11 at the same time that pin 29 arrives adjacent to lip 46.

Figure 8:
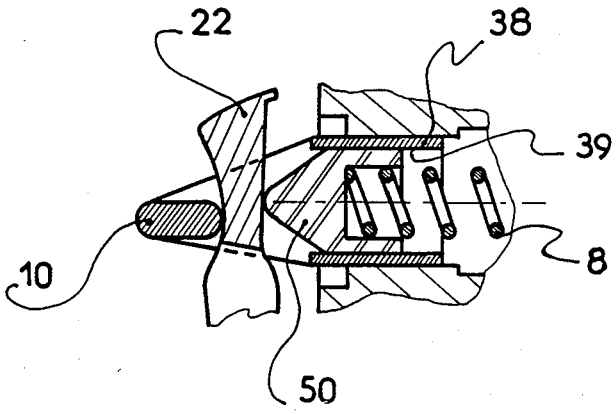
FIG. 8 is a partial side view relating to one embodiment of the invention.

FIG. 8 illustrates an alternative embodiment in which pin 29 is replaced by a piston 50 slidably mounted along a longitudinal direction, parallel to the sliding direction of pressure element 10.

For example, sliding piston 50 is guided in longitudinal orifice 44 of element 38.

Figure 9:
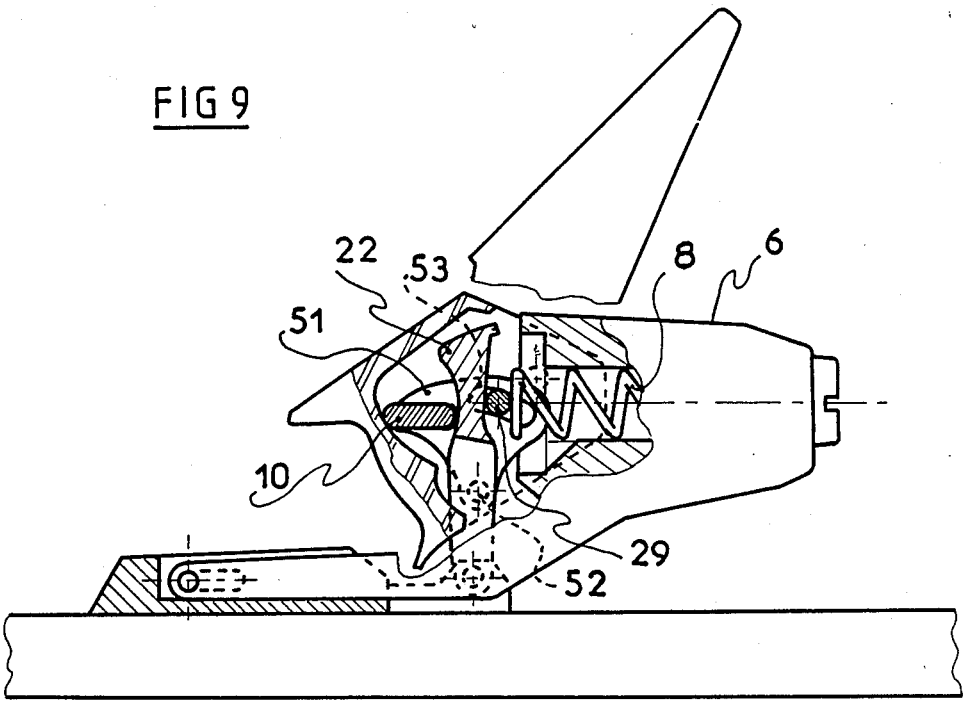
FIGS. 9–12 illustrate a side view of variations of the binding.

FIG. 9 illustrates another alternative embodiment in which pressure element 10 is affixed to a rocker 51 which is journalled with respect to body 6 around a transverse axis 52.

Rocker 51 has two lateral side plates, one on each side of lever 22, which are connected on the front of the lever by pressure element 10.

On the rear of lever 22 the lateral side plates of rocker 51 have respectively a slot 53, oriented generally longitudinally, which makes it possible to guide pin 29 in substantially the same fashion as slots 42 and 43 of element 38 (as shown in FIG. 3).

The binding shown in FIG. 9 has an operation substantially identical to that of the previously described binding, except that the pressure element 10 does not slide longitudinally but pivots around an axis 52 connected to body 6.

Figure 10:
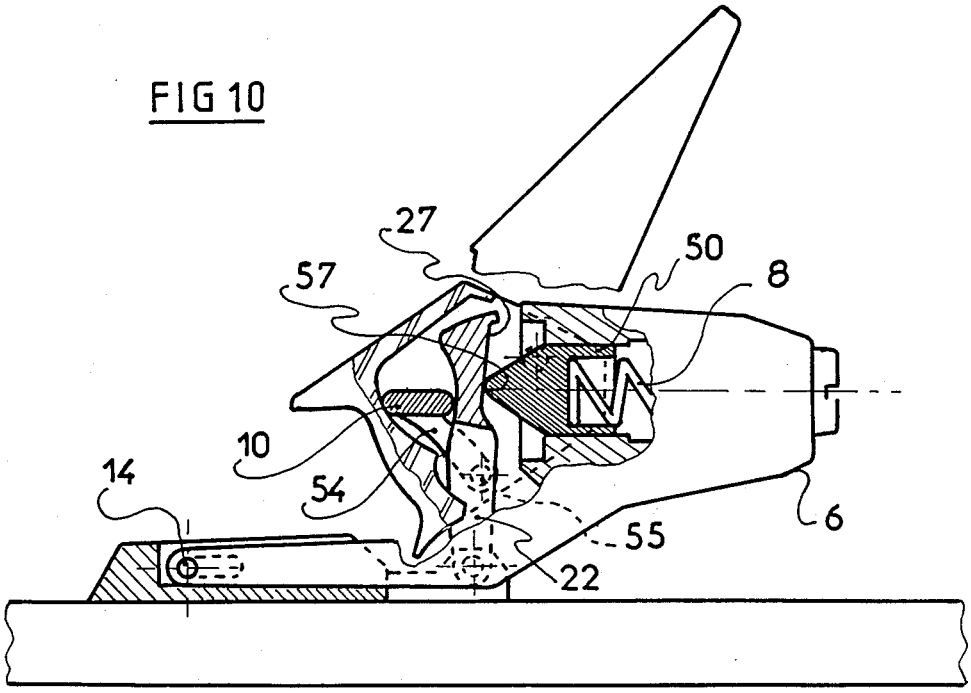

FIG. 10 illustrates another variation in which pressure element 10 is mounted at the end of a rocker 54 which is itself pivotably mounted around a transverse axis 55 connected to body 6.

Pin 29 is replaced by a piston 50, with a pressure nose 57 in contact with ramp 27 of lever 22. Piston 50 is slidably longitudinally guided with respect to body 6.

Figure 11:
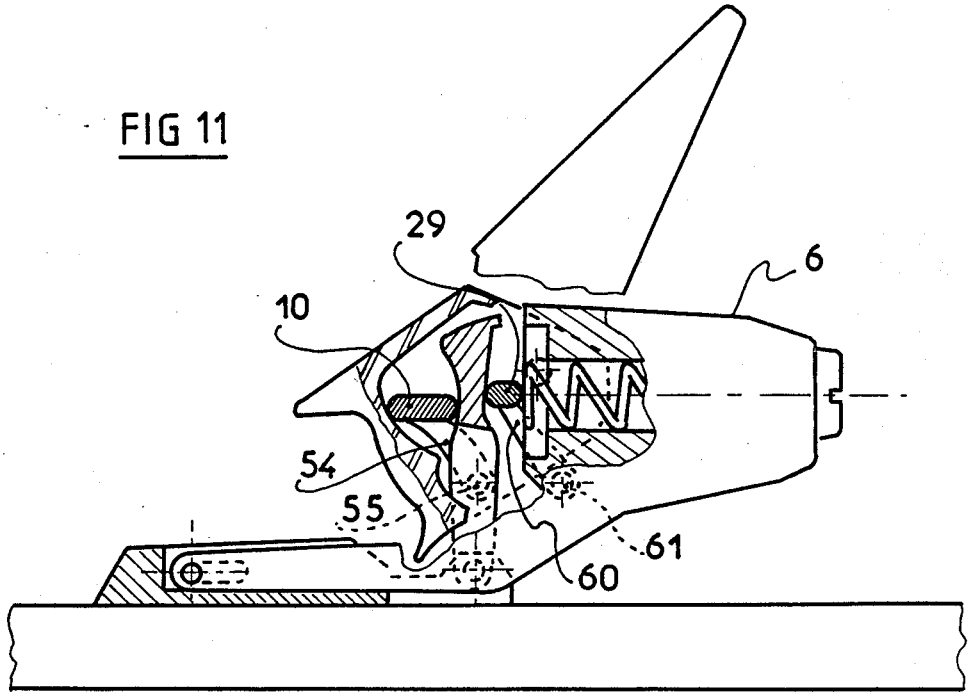

FIG. 11 illustrates an alternative embodiment in which pressure element 10 is mounted at the end of a rocker 54, and the auxiliary pressure element, i.e., in this case pin 29, is likewise mounted at the end of a rocker 60, journalled with respect to body 6 around a transverse axis 61.

The operation of this binding is similar to that which has been described previously, apart from the fact that pressure element 10 and pin 29 are caused to pivot, and are not guided longitudinally with respect to body 6.

Figure 12:
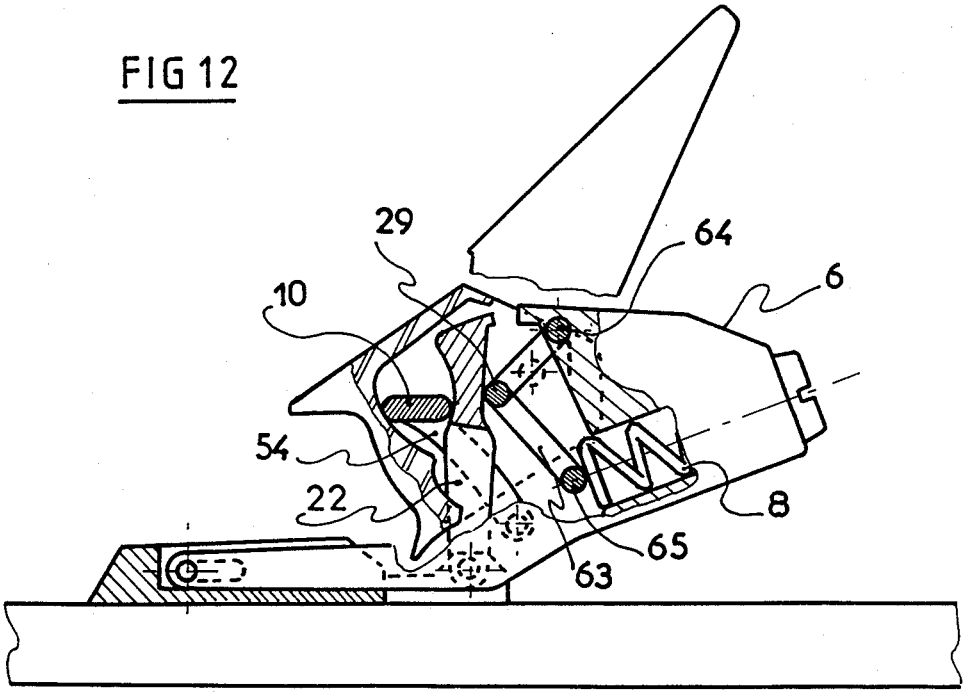

FIG. 12 illustrates another alternative embodiment in which the auxiliary pressure element, i.e., in this case pin 29, is carried by a complex rocker 63. The rocker has a bent shape, the bend being oriented in the direction of lever 22, and pin 29 being substantially at the corner of the bend.

Rocker 63 is journalled with respect to body 6 at one of its ends around an axis 64, and at its other end it has means, such as a transverse pin 65, to receive the pressure of spring 8. This construction makes it possible to amplify the intensity of the pressure exerted by spring 8 through rocker 63 and lever 22 to pressure element 10 and ramp 11 of the jaw.

Figure 13:
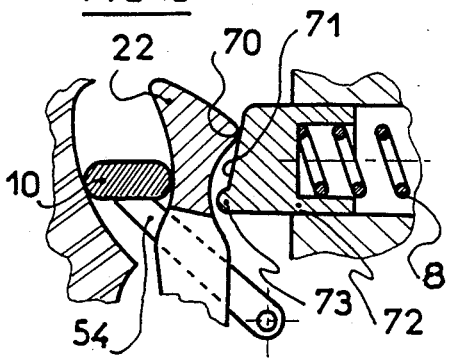
FIGS. 13–15 are partial side views illustrating other variations of the invention.

FIG. 13 illustrates another embodiment in which the pressure nose and the ramp are modified at the level of the linkage between lever 22 and the auxiliary pressure element.

Thus, lever 22 has on the side towards spring 8 a pressure nose 70 which is in contact with a ramp 71 carried by the auxiliary pressure element, which in this case is a piston 72 slidably longitudinally mounted with respect to body 6. As with ramp 27, ramp 71 is compressive or neutral, and preferably, it has in its lower portion a lip 73 to limit the displacement of pressure nose 70, and, in this way, to limit the amplitude of the pivoting movement of body 6 and of its arms 12 and 13 around axis 14.

Figure 14:
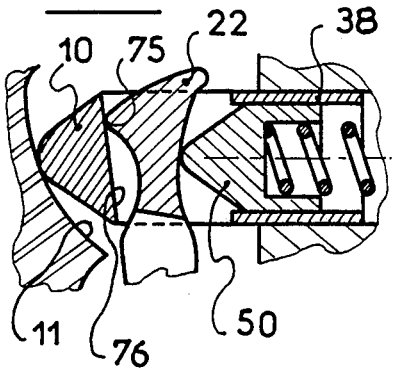

FIG. 14 illustrates another alternative embodiment in which the pressure nose and ramp are changed at the level of the linkage between lever 22 and pressure element 10. Thus, lever 22 has a pressure nose 75, on the side towards ramp 11 of jaw 3, which is in contact with a ramp 76 carried by pressure element 10. As with ramp 28, ramp 76 is compressive or neutral. Furthermore, the assembly of pressure element 10 and of the auxiliary pressure element is of the same type as that of FIG. 8, i.e., it comprises a piston 38 which is longitudinally slidable with respect to body 6 and an auxiliary piston 50 which is longitudinally slidable with respect to piston 38.

Figure 15:
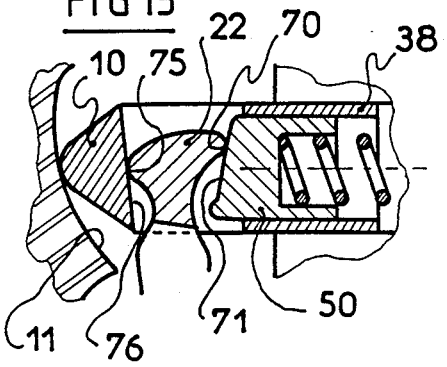

FIG. 15 illustrates an alternative embodiment according to which the pressure nose and the ramps are changed on each side of lever 22. Thus, lever 22 has on the side towards spring 8 a pressure nose 70 in contact with a ramp 71, and on the side towards ramp 11 of the jaw, a pressure nose 75 in contact with ramp 76 of pressure element 10.

Figure 16:
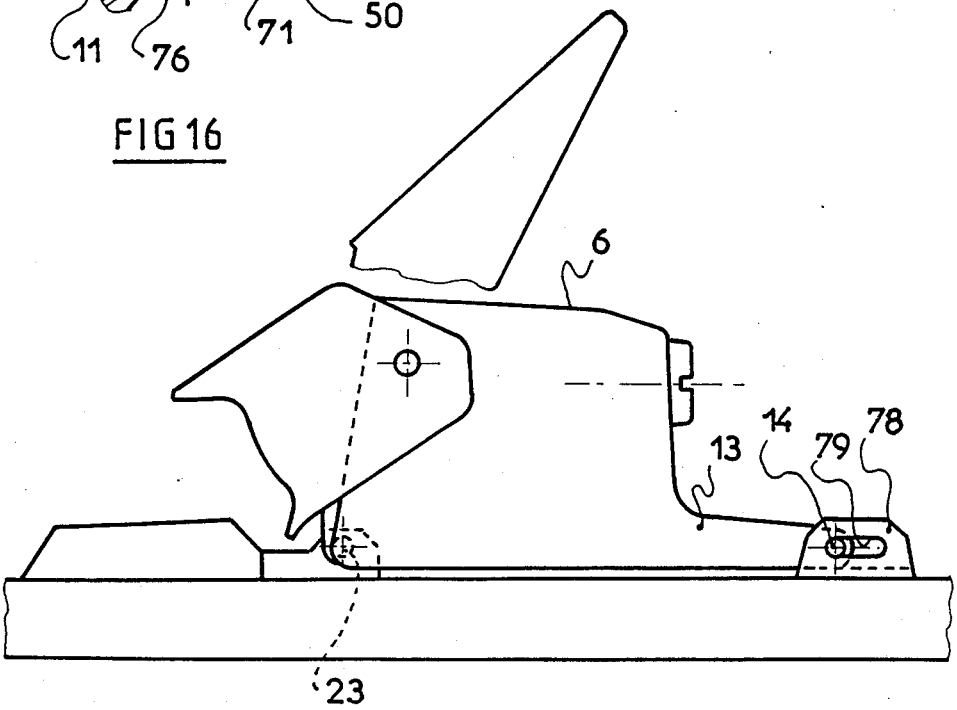
FIGS. 16–18 illustrate a side view of other variations of the binding.

FIG. 16 illustrates another variation in which arms 12 and 13 which carry the body 6 of the binding are oriented no longer towards the rear but in this case towards the front, beginning at the journal axis 14. Journal axis 14 of arms 12 and 13 is positioned to the rear of lever 22 and of its pivot axis 23.

Axis 14 of arms 12 and 13 is carried by a bearing 78, affixed to the upper surface of the ski which has a slot 79 longitudinally oriented to allow for the elastic retreat of the binding.

Figure 17:
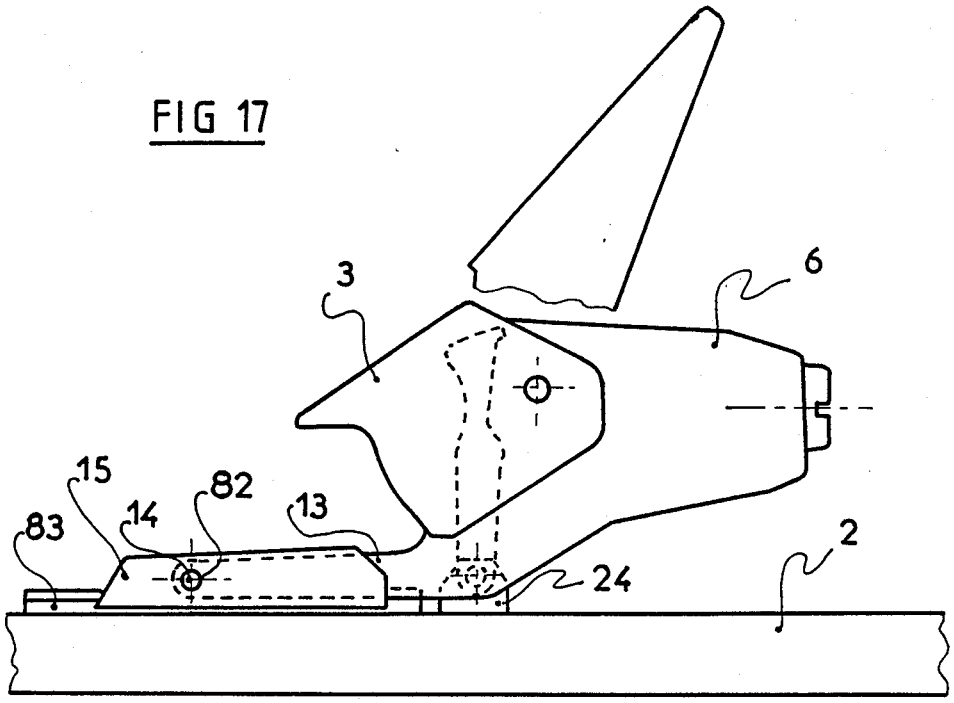
Figure 18:
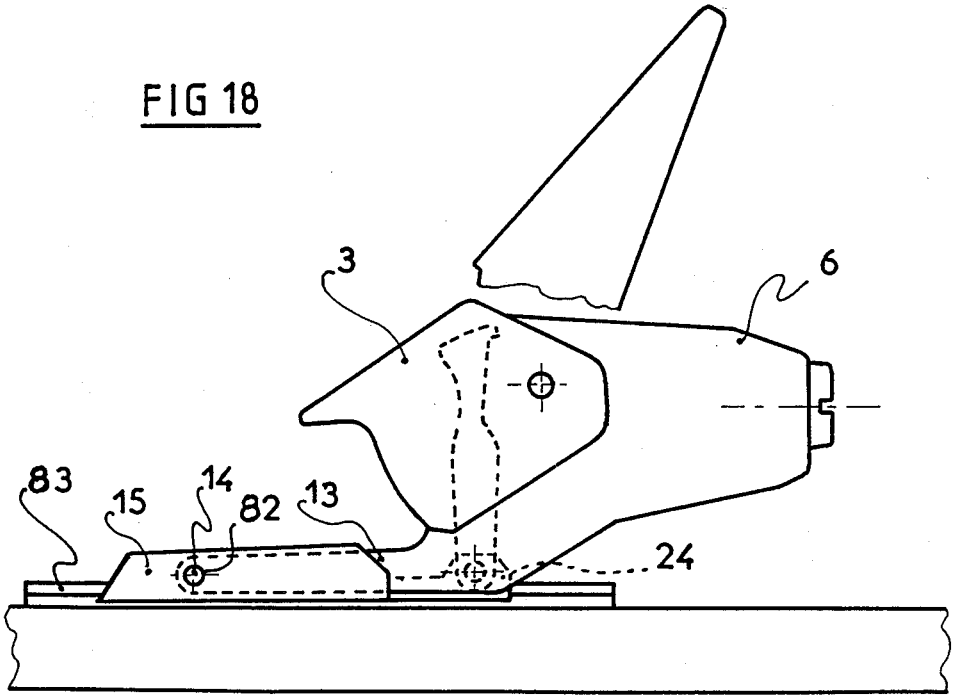

FIGS. 17 and 18 illustrate an alternative embodiment in which platform 15 displaces with arms 12 and 13 and body 6 during a return force. To this end, platform 15 is slidably mounted on a track 83 which is oriented along the longitudinal direction of the ski, the mounting being achieved directly or by means of length adjustment means.

Slot 16 of axis 14 is replaced by bore 82 which carries axis 74.

In the embodiment of FIG. 17, lever 22 is journalled with respect to the ski by means of a bearing 24 affixed to the ski directly or by means of length adjustment means. In this fashion, during a return force platform 15 returns, but bearing 24 remains immobile. The binding behaves in the same fashion as before and the elastic return is assured by the lever 22 as has been previously described with reference to FIG. 6.

In the alternative embodiment of FIG. 18, lever 22 is journalled on a bearing 24 which is connected to platform 15 and thus slides with this platform during a return force.

The elastic return is not, in this embodiment, assured by lever 22. It is assured by conventional means which act particularly on platform 15.

Naturally, the present description is given only by way of non-limiting example and one can adopt other means of performing the invention without going beyond the scope thereof.

In particular, the means which make it possible to elastically return the binding can be assisted by conventional means such as a longitudinal spring acting, for example, on the journal axis 14 of arms 12 and 13 to the ski. Likewise, these means which make possible the elastic return can be absent, and in this case replaced entirely by conventional means.

What is claimed is:

1. A safety binding adapted to releasably hold a boot on a ski, said binding comprising:

a) means for securing said binding to said ski;

b) movable body having spaced lateral arms pivotably connected to said securing means along a first axis which is substantially transverse to the longitudinal extent of a ski on which said binding is adapted to be positioned;

c) a jaw pivotably connected to said body along a second axis which is substantially transverse to the longitudinal extent of said ski, said jaw comprising means for engaging and holding a portion of said boot on said securing means in a retention position when said boot is positioned on said securing means and said binding is attached to said ski, said jaw being pivotable about said second axis from said retention position to a release position by movement of said jaw relative to said body during skiing; and d) means comprising common elastic energy storing means for biasing said jaw towards said body and for biasing said body towards said ski and means for increasing the biasing force of said jaw towards said ski in response to upward movement of said body.

2. The safety binding as defined by claim 1, further comprising a manual release lever which comprises means for disengaging a boot from said binding when said boot is positioned on said ski.

3. The safety binding as defined by claim 1, wherein said securing means are attached to an upper ski surface.

4. The safety binding as defined by claim 1, wherein said securing means comprise a platform having a lower surface adapted to abut the upper surface of said ski, an upper surface adapted to support the sole of said boot, and two portions adapted to receive said spaced lateral arms.

5. The safety binding as defined by claim 4, wherein said platform comprises means for guiding said spaced lateral arms slidably over a portion of said platform along the longitudinal extent of said ski, and wherein said spaced lateral arms are adapted to be connected to said guiding means.

6. The safety binding as defined by claim 5, wherein said guiding means comprise grooves adapted to receive said spaced lateral arms.

7. The safety binding as defined by claim 15, wherein said energy transferring means comprise a second pressure element in contact with said elastic energy storing means, a lever in contact with said second pressure element, and a first pressure element which includes a first portion in contact with said lever and a second portion in contact with a ramp located on an inner surface of said jaw.

8. The safety binding as defined by claim 5, wherein each of said spaced lateral arms comprises a pin slideably and pivotably connected to a slot in said platform.

9. The safety binding as defined by claim 4, wherein said two portions adapted to receive said spaced lateral arms comprise two grooves which are substantially parallel to the longitudinal extent of said ski.

10. The safety binding as defined by claim 1, wherein each of said spaced lateral arms comprises a first portion connected at a free end of said arm to said first axis and extending towards said moveable body along a direction which is substantially parallel to the longitudinal extent of said ski, and a second portion extending from said first portion, said second portion being adapted to project upwardly from the upper surface of said ski towards said binding.

11. The safety binding as defined by claim 10, wherein the spacing between said lateral arms is in a range of from a distance equal to the width of a sole of said boot to a distance less than the width of the sole of said boot adapted to be positioned on said ski and is in a range of from a distance equal to the width of said platform to a distance less than the width of said platform.

12. The safety binding as defined by claim 1, wherein said jaw comprises an upper extension adapted to engage the upper surface of the sole of said boot, a lower extension adapted to engage a bottom surface of the sole of said boot, and a ramp located on an inner surface of said jaw, said jaw ramp further comprising an upper compressive zone, a lower opening zone adjacent to said upper zone, and a ridge positioned between said zones.

13. The safety binding as defined by claim 12, wherein said upper zone comprises means for compressing said elastic energy storing means when said jaw pivots upwardly away from said ski, whereby said upper zone is biased with increasing force and said jaw is increasingly biased back towards said ski.

14. The safety binding as defined by claim 13, wherein said lower zone comprises means for decompressing said elastic energy storing means and for biasing said jaw upwardly from said ski.

15. The safety binding as defined by claim 1, wherein said biasing means comprise means for storing elastic energy and means for reversibly transferring elastic energy from said elastic energy storing means to said jaw.

16. The safety binding as defined by claim 15, wherein said elastic energy storing means are located along a line which is substantially horizontal, with respect to the longitudinal extent of said ski, when said binding is at its lowermost position with respect to an upper surface of said ski.

17. The safety binding as defined by claim 15, wherein said elastic energy storing means are located along a line which forms an angle to the longitudinal extent of said ski when said binding is at its lowermost position with respect to an upper surface of said ski.

18. The safety binding as defined by claim 15, wherein said elastic energy storing means comprise at least one spring.

19. The safety binding as defined by claim 7, wherein said second pressure element comprises a pin adapted to be slidably connected to said first pressure element by a rocker plate which engages said pin.

20. The safety binding as defined by claim 7, wherein a portion of said second pressure element that is in contact with said lever includes a ramp, said ramp of said second pressure element further comprising means for compressing said elastic energy storing means when said body pivots upwardly away from said ski.

21. The safety binding as defined by claim 20, wherein said second pressure element ramp further comprises a projecting lip at its lower portion which comprises means for limiting movement of said safety binding away from said ski.

22. The safety binding as defined by claim 7, wherein said second pressure element comprises a piston adapted to be mounted slideably with respect to the longitudinal extent of said ski in an orifice of said body.

23. The safety binding as defined by claim 7, wherein said second pressure element comprises a rocker device pivotably connected to said body along an axis which is substantially transverse to the longitudinal extent of said ski.

24. The safety binding as defined by claim 23, wherein said rocker device comprises first and second ends, said substantially transverse axis pivotably connecting said rocker device to said body being located at said first end of said rocker device, said second end of said rocker device being in contact with said elastic energy storing means, and an intermediate rocker device portion between said first end and said second end being in contact with said second pressure element.

25. The safety binding as defined by claim 7, wherein said lever is pivotably connected, along an axis which is substantially transverse to the longitudinal extent of said ski, to means for securing said lever to said ski.

26. The safety binding as defined by claim 25, wherein said means for securing said lever to said ski are adapted to be spaced from said means for securing said binding to said ski along an upper ski surface.

27. The safety binding as defined by claim 26, wherein said lever securing means and said binding securing means are positioned substantially along opposite sides of said body.

28. The safety binding as defined by claim 25, wherein said lever comprises a lower end which is pivotably connected along said substantially transverse axis, and an upper end, said upper end comprising a first surface facing said second pressure element and a second surface facing said first pressure element, and wherein at least one of said first and said second pressure elements comprises a pressure nose slideably contacting one of said first and second surfaces of said lever.

29. The safety binding as defined by claim 28, wherein said lever ramp comprises means for compressing said elastic energy storing means when said body pivots upwardly away from said ski.

30. The safety binding as defined by claim 25, wherein a ramp is located on said first pressure element, and wherein said first pressure element ramp comprises means for compressing said elastic energy storing means when said jaw pivots upwardly away from said ski.

31. The safety binding as defined by claim 25, wherein said lever comprises upper and lower ends, said lower end being pivotably connected to said means for securing said lever to said ski, and wherein said upper end comprises first and second ramps, said first lever ramp slideably contacting said second pressure element and said second lever ramp slideably contacting said first pressure element.

32. The safety binding as defined by claim 31, wherein at least one of said first and second lever ramps comprises means for compressing said elastic energy storing means when said jaw pivots upwardly away from said ski.

33. The safety binding as defined by claim 31, wherein said binding is adapted to be mounted slideably with respect to the longitudinal extent of said ski, and wherein at least one of said first and second lever ramps comprises means for elastically returning said binding along said ski in a predetermined direction.

34. The safety binding as defined by claim 31, wherein said first lever ramp includes a projecting lip at its upper portion which comprises means for limiting movement of said safety binding away from said ski.

35. The safety binding as defined by claim 7, wherein said first pressure element comprises a piston which is in contact with said elastic energy storing means and which is slideably mounted in said body longitudinally with respect to the longitudinal extent of said ski, and wherein an end of said piston comprises a pushing element.

36. The safety binding as defined by claim 35, further comprising a ramp located on an inner surface of said jaw, wherein said pushing element comprises a first pressure nose which slideably contacts said jaw ramp and a second pressure nose which slideably contacts said lever.

37. The safety binding as defined by claim 35, wherein said second pressure element comprises a pin adapted to be mounted slideably longitudinally with respect to said body and wherein said piston comprises means for guiding said pin longitudinally with respect to the longitudinal extent of said ski.

38. The safety binding as defined by claim 37, wherein said guiding means comprise slots located on substantially opposed surfaces of said piston.

39. The safety binding as defined by claim 7, wherein said first pressure element comprises a rocker arm which is pivotably connected along an axis which is substantially transverse with respect to the longitudinal extent of said ski.

40. The safety binding as defined by claim 39, wherein said rocker arm comprises a pressure nose which slideably contacts said jaw ramp, said rocker arm further comprising means for slideably guiding said second pressure element substantially longitudinally with respect to said ski.

41. The safety binding as defined by claim 40, wherein said second pressure element comprises a pin mounted transversely with respect to the longitudinal extent of said ski, and wherein said pin is adapted to slide along said guiding means of said rocker arm.

42. A safety binding adapted to secure one end of a ski boot to a ski, comprising:

a) means for securing said binding to said ski;

b) a body having spaced lateral arms pivotably connected to said securing means along an axis which is substantially transverse to the longitudinal extent of said ski;

c) a jaw pivotably connected to said body along an axis which is substantially transverse to the longitudinal extent of said ski, said jaw further comprising means for retaining an end of said boot;

d) means for biasing said jaw towards said ski, said biasing means comprising elastic energy storing means, a jaw ramp located on an inner surface of said jaw, and a first pressure element slideably contacting said jaw ramp; and e) a lever pivotably connected to said securing means along an axis which is substantially transverse to the longitudinal extent of said ski, said lever comprising an upper portion located between said first pressure element and said elastic energy storing means.

43. The safety binding as defined by claim 42, wherein said spaced lateral arms are pivotably connected to said securing means at a position located in front of the position where said lever is pivotably connected to said securing means, as viewed with respect to said ski when said binding is attached thereto.

44. The safety binding as defined by claim 42, wherein said spaced lateral arms are pivotably connected to said securing means at a position located to the rear of the position where said lever is pivotably connected to said securing means, as viewed with respect to said ski when said binding is attached thereto.

45. The safety binding as defined by claim 42, wherein said first pressure element comprises a first pressure nose which slideably contacts a ramp on said lever.

46. The safety binding as defined by claim 45, wherein said lever ramp comprises means for compressing said elastic energy storing means when said body pivots away from said ski.

47. The safety binding as defined by claim 42, wherein said first pressure element comprises a rocker device pivotably connected to said body along an axis which is substantially transverse with respect to the longitudinal extent of said ski, and wherein a second pressure element comprises a pin slideably connected to said rocker device.

48. The safety binding as defined by claim 45, wherein said lever ramp comprises a projecting lip at its upper portion which comprises means for limiting movement of said safety binding away from said ski.

49. The safety binding as defined by claim 45, wherein the substantially transverse axis along which said spaced lateral arms are connected to said securing means is located on a platform which is adapted to be secured to said ski, said axis being moveable over a portion of said platform with respect to the longitudinal extent of said ski.

50. The safety binding as defined by claim 45, wherein a second pressure element and said lever contact each other along a line, and said first pressure element and said lever contact each other along a line, said two lines being offset from each other.

51. The safety binding as defined by claim 45, wherein said first pressure element comprises a piston slidably connected to said body, said piston comprising two side elements which encompass a portion of said lever and which comprise means for slideably guiding said second pressure element with respect to the longitudinal extent of said body.

52. The safety binding as defined by claim 51, wherein said second pressure element comprises a pin oriented transversely with respect to the longitudinal extent of said body, and wherein said pin is guided in said guide means of said side elements of said piston.

53. The safety binding as defined by claim 51, wherein said second pressure element comprises a first piston mounted slideably within a second piston which is mounted slideably with respect to the longitudinal extent of said body.

54. The safety binding as defined by claim 42, wherein said first pressure element comprises a ramp which slideably contacts a first pressure nose on said lever.

55. The safety binding as defined by claim 54, wherein said pressure element ramp comprises means for compressing said elastic energy storing means when said body pivots away 56. The safety binding as defined by any one of claims 45, 55, further comprising a second pressure element connecting said elastic energy storing means and said lever.

57. The safety binding as defined by claim 42, wherein said first pressure element comprises a rocker device pivotably connected to said body along an axis which is substantially transverse with respect to the longitudinal extent of said ski, and wherein a second pressure element comprises a piston slideably connected to said body.

58. The safety binding as defined by claim 42, wherein said first pressure element comprises a first rocker device pivotably connected to said body along an axis which is substantially transverse with respect to the longitudinal extent of said ski, and wherein a second pressure element comprises a second rocker device pivotably connected to said body.

59. The safety binding as defined by claim 42, wherein a second pressure element contacts said lever at a location which is spaced vertically from the contact between said first pressure element and said lever.

60. The safety binding as defined by claim 42, wherein said securing means are adapted to be slideably connected to said ski along at least a portion of said said ski.

61. The safety binding as defined by claim 42, wherein said securing means comprise a platform to which said spaced lateral arms are adapted to be connected, and wherein the spacing between said lateral arms is less than the width of said platform, said platform further comprising two grooves, each of said grooves being adapted to receive at least a portion of one of said spaced lateral arms.

62. The safety binding as defined by claim 42, wherein said first pressure element comprises a piston slideably connected to said body, said piston comprising means for receiving at least a portion of said lever and means for slideably guiding a second pressure element within said piston.

63. The safety binding as defined by claim 62, wherein said second pressure element comprises a pin oriented transversely with respect to the longitudinal extent of said body, and wherein said pin is slideably guided in said guiding means of said piston.

64. The safety binding as defined by claim 62, wherein said second pressure element comprises a first piston positioned slideably within a second piston which is mounted slideably within said body.

65. The safety binding as defined by claim 42, wherein said first pressure element comprises a rocker device pivotably connected to said body along an axis which is substantially transverse with respect to the longitudinal extent of said ski, and wherein a second pressure element comprises a pin slideably connected to said rocker device.

66. The safety binding as defined by claim 42, wherein said first pressure element comprises a rocker device pivotably connected to said body along an axis which is substantially transverse with respect to the longitudinal extent of said ski, and wherein a second pressure element comprises a piston slideably connected to said body.

67. The safety binding as defined by claim 42, wherein said first pressure element comprises a first rocker device pivotably connected to said body along an axis which is substantially transverse with respect to the longitudinal extent of said ski, and wherein a second pressure element comprises a second rocker device pivotably connected to said body along a substantially transverse axis.

68. The safety binding as defined by claim 42, wherein said securing means are attached to an upper ski surface.

69. A safety binding adapted to releasably hold a boot on a ski, said binding comprising:

a) means for securing said binding to said ski;

b) a movable body having spaced lateral arms pivotably connected to said securing means along a first axis which is substantially transverse to the longitudinal extent of a ski on which said binding is adapted to be positioned;

c) a jaw pivotably connected to said body along a second axis which is substantially transverse to the longitudinal extent of said ski, said jaw comprising means for engaging and holding a portion of said boot on said securing means when said boot is positioned on said securing means and said binding is attached to said ski; and d) means comprising common elastic energy storing means for biasing said jaw towards said ski and for biasing said body towards said ski and means for increasing the biasing force of said jaw towards said ski in response to upward movement of said body, wherein said biasing means comprise means for storing elastic energy means for reversibly transferring elastic energy from said elastic energy storing means to said jaw, and means for adjusting the amount of elastic energy stored in said elastic energy storing means.

70. The safety binding as defined by claim 69, wherein said adjusting means comprise a screw which compresses said elastic energy storing means when said screw is rotated in a first direction and which decompresses said elastic energy storing means when said screw is rotated in a second direction.

71. A safety binding adapted to releasably hold a boot on a ski, said binding comprising:

a) means for securing said binding to said ski;

b) a movable body having spaced lateral arms pivotably connected to said securing means along a first axis which is substantially transverse to the longitudinal extent of a ski on which said binding is adapted to be positioned;

c) a jaw pivotably connected to said body along a second axis, said jaw comprising means for engaging and holding a portion of said boot on said securing means and for permitting pivotal movement along said second axis when said boot is secured by said securing means and said binding is attached to said ski; an d) means comprising common elastic energy storing means for biasing said jaw towards said ski and for biasing said body towards said ski and means for increasing the biasing force of said jaw towards said ski in response to upward movement of said body.

72. The binding of claim 71 wherein said common elastic storing means biases said body about said first axis and biases said jaw about said second axis.

73. A safety binding adapted to releasably hold a boot on a ski, said binding comprising:

a) means for securing said binding to said ski;

b) a movable body pivotably connected to said securing means along a first axis which is substantially transverse to the longitudinal extent of the ski on which said binding is adapted to be positioned;

c) a jaw pivotably connected to said body along a second axis which is substantially transverse to the longitudinal extent of said ski, said jaw comprising means for engaging and holding a portion of said boot on said securing means when said boot is positioned on said securing means and said binding is attached to said ski; and d) means, comprising a common elastic energy storing element, for exerting a biasing force for biasing said jaw relative to said body and for biasing said body relative to said ski, and means for increasing said biasing force in response to upward movement of said body and/or upward movement of said jaw.

74. A safety binding adapted to releasably hold a boot on a ski, said binding comprising:

a) means for securing said binding to said ski;

b) a movable body having spaced lateral arms pivotably connected to said securing means along a first axis which is substantially transverse to the longitudinal extent of a ski on which said binding is adapted to be positioned;

c) a jaw pivotably connected to said body along a second axis which is substantially transverse to the longitudinal extent of said ski, said jaw comprising means for engaging and holding a portion of said boot on said securing means in a retention position when said boot is positioned on said securing means and said binding is attached to said ski, said jaw being pivotable about said second axis from said retention position to a release position by movement of said jaw relative to said body during skiing; and d) means comprising common elastic energy storing means located in said body for biasing said jaw towards said ski and for biasing said body towards said ski and means for increasing the biasing force of said jaw towards said ski in response to upward movement of said body.

75. A safety binding adapted to releasably hold a boot on a ski, said binding comprising:

a) means for securing said binding to said ski;

b) a movable body having spaced lateral arms pivotably connected to said securing means along a first axis which is substantially transverse to the longitudinal extent of a ski on which said binding is adapted to be positioned;

c) a jaw pivotably connected to said body along a second axis which is substantially transverse to the longitudinal extent of said ski, said jaw comprising means for engaging and holding a portion of said boot on said securing means in a retention position when said boot is positioned on pivotable about said second axis from said retention position to a release position by movement of said jaw relative to said body during skiing; and d) means comprising common elastic energy storing means for biasing said jaw towards said ski body and for biasing said body towards said ski and means for increasing the biasing force of said jaw towards said ski in response to upward movement of said body said body being movable during skiing.

* * * * *